United States Patent [19]

Pete et al.

[11] Patent Number: 4,749,624

[45] Date of Patent: Jun. 7, 1988

[54] COMPOSITE FERROUS CASTINGS

[75] Inventors: George H. Pete; Jerry E. Bafford, both of Decatur, Ill.

[73] Assignee: Wagner Castings Company, Decatur, Ill.

[21] Appl. No.: 918,907

[22] Filed: Oct. 15, 1986

[51] Int. Cl.[4] ..... B21D 51/02

[52] U.S. Cl. ..... 428/586; 428/614; 428/677; 428/682

[58] Field of Search ..... 428/586, 614, 677, 682, 428/684; 148/321, 909

[56] References Cited

U.S. PATENT DOCUMENTS 1,729,848 10/1929 Walker ..... 164/48

3,170,452 2/1965 Dobovan ..... 123/188 S 4,008,052 2/1977 Vishnevsky et al. ..... 164/100

4,209,058 6/1980 Spalding ..... 164/100

FOREIGN PATENT DOCUMENTS 2073633 10/1981 United Kingdom ..... 428/614

*Primary Examiner*—L. Dewayne Rutledge

*Assistant Examiner*—George Wyszomierski

*Attorney, Agent, or Firm*—Wallenstein, Wagner, Hattis & Strampel, Ltd.

[57] ABSTRACT

Cast iron selected from the group consisting of white iron, compacted graphite iron, malleable iron, gray iron, and ductile iron is cast in a mold in which steel or metal, such as a tube defines a portion of the mold form.

11 Claims, 4 Drawing Sheets

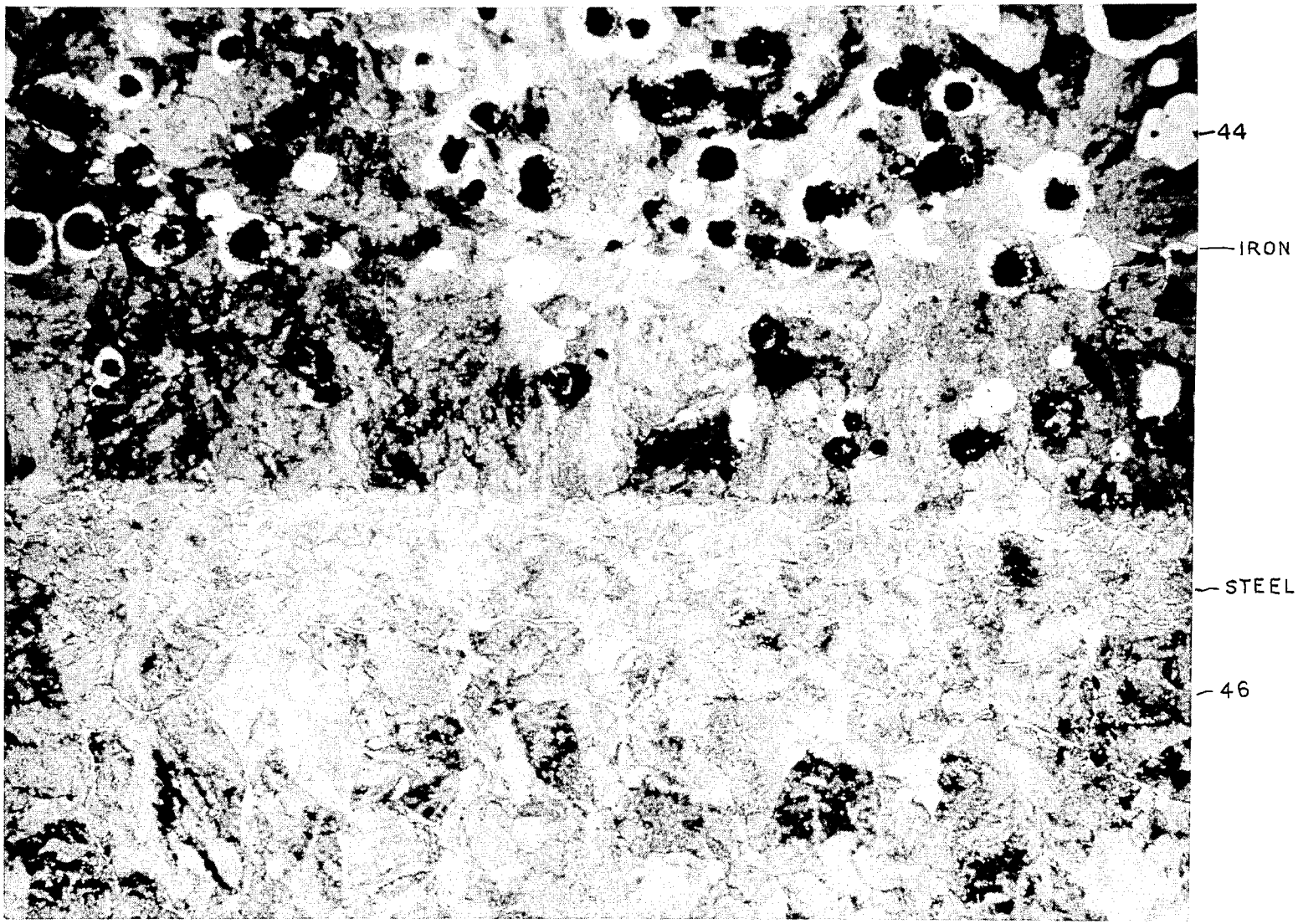
FIG. 4 Magnification (200x)

COMPOSITE FERROUS CASTINGS

FIELD OF THE INVENTION

This invention relates to methods of using and producing ferrous castings with forged or sheet materials used as part of the mold form and thereby integrated into the cast product.

BACKGROUND OF THE INVENTION

Ferrous castings are used in the manufacture of various parts for machines, engines and the like. For example, a crankshaft or steering gear may be a ferrous casting. In the manufacture of a crankshaft, it is often necessary to provide a series of connected non-linear passages through the ferrous casting to carry lubricants. These connected passages are most often conventionally provided into the casting by a gun drilling method. The drilled passages typically require counterboring, tapping, and plugging in order to provide a generally smooth, continuous, winding passage through the casting. This method of providing a continuous passage is relatively expensive and time consuming. In some cases, the drilling operation cannot provide the optimum design from the standpoint of crankshaft functionality, and the crankshaft has to be designed around the limitations of the drilling operation. Thus, there has been a need to provide an improved means for manufacture of such a casting.

Additionally, there exist many applications where ferrous castings possess the requisite mechanical strength properties, but where ferrous castings are presently considered undesirable or unacceptable due to the inherent limitations of other metallurgical properties associated with the castings. For example, crankshaft crankpins inherently provide a rotating mass, and therefore need a counterweight to balance the mass. Large dimension crankpins conventionally give rise to larger counterweights which therefore require a larger crankcase and related engine components. There exists a need to be able to reduce the size of the crankcase and the counterweight independently of the design considerations of the crankpins.

As another example, many applications exist where advantageously part but not all of a ferrous casting is forged and metallurgically bonded to a casting. However, it may be impractical or impossible to provide such a product because of the inability to metallurgically bond forged metal to cast metal. For example, currently automotive and light truck drive line U-joints are welded to the drive shaft tube. Heavy truck torque arms are currently produced by welding a relatively expensive forged eye to the end of a section of heavy walled alloy steel tubing. Both could advantageously be fabricated in part from a casting. However, the U-joint or eye cannot be made in commercial practice by ferrous casting because the casting cannot be easily bonded by welding to the forged tubing.

The art of ferrous castings is well developed. For example, various prior art patents depict processes for the manufacture of castings having complex shapes and forms. Walker in U.S. Pat. No. 1,729,848 discloses a method of manufacture for white iron castings wherein copper plated steel rods are utilized as reinforcements in the casting. Such white iron castings are typically utilized as grates inasmuch as the white iron is not heat treated and is therefore very brittle, yet hard.

Dobovan in U.S. Pat. No. 3,170,452 discloses that a cylinder head of cast iron maybe cast with a wear and corrosion resistant steel metal insert in the shape of a valve seat coated with a suitable brazing alloy. Typically, the insert, which is steel, is coated with a layer of a nickel base brazing alloy. The valve seat is thus cast in place with the gray cast iron.

Vishnevsky, et al. in U.S. Pat. No. 4,008,052 discloses a bimetallic casting wherein a boron containing alloy is provided intermediate the materials being cast. The materials involved are generally known as super alloys.

Spalding in U.S. Pat. No. 4,209,058 discloses yet another die casting operation and, in particular, a casting process whereby a section of steel tubing is die cast in combination with an alloy of magnesium or aluminum.

There has remained, however, a need to provide ferrous castings and methods for making such castings which can be used in a wider variety of applications, as noted above.

SUMMARY OF THE INVENTION

In a principal aspect, the present invention is an improved method for using and producing various cast irons as a composite article in combination with various metal or steel forms. The metal or steel forms may serve as part of the mold form for the cast iron material, which preferably includes cast iron selected from the group consisting of white iron, compacted graphite iron, malleable iron, gray iron, and ductile iron.

In one preferred embodiment the metal form component consists of tubular or other hollow conduit forms of steel or other alloys compatible with cast iron. For example, the invention may comprise a shaped ferrous casting having a multi-sectioned, non-linear passageway therethrough. By "multi-sectioned, non-linear passageway" is meant a passage that has at least two, and most preferably more than two non-linear sections defining a tortuous pathway through the casting.

The casting of this preferred embodiment is provided by initially bending a steel or other metal tube or conduit into a predetermined, multi-sectioned, non-linear shape, and then positioning the conduit in a mold form such that the ends of the steel conduit will extend through the wall of the product to be cast. The mold form is then completed to define the remainder of the shape of the product to be cast. Thereafter, the mold form is filled with iron thereby enveloping the conduit, at least in part. The iron is then hardened, leaving a multi-sectioned, non-linear passage of any desired shape through the ferrous casting, without the necessity for any drilling operation.

In another preferred embodiment, the ferrous casting will include tubular inserts as a method to control the casting weight and weight distribution. By inserting a tubular element into the ferrous casting during the casting operation as previously described, it is possible to reduce the weight of the casting or to alter the center of mass of the casting independently of the physical size or configuration of the casting. In some applications, i.e., the crankpins previously mentioned, this embodiment can be used in a more complex manner to (i) reduce the principal rotating mass without affecting the dimensions thereof and (ii) thereby reduce both the size and weight of the counterweight of the principal rotating mass.

The invention may also be used as a method to produce multi-component elements in which a forged steel or metal form defines a part of the outside surface of the composite steel or metal and cast product with the cast iron metallurgically bonded to metal form component. By way of example, in this method a steel tube or conduit is positioned in the mold form such that a portion of the exterior surface of the tube will define a predetermined portion of the exterior surface of the product to be cast. The predetermined portion of the product to be cast is chosen to define the location at which the composite cast product may be metallurgically bonded by welding, for example. The mold form is then completed to define the remainder of the product to be cast, and the completed mold form is filled with iron which is cooled to provide the final product. This cast component may then be metallurgically bonded to another part, i.e., by welding, thus producing an integral multi-component element comprising both cast and non-cast components, metallurgically bonded throughout.

One further embodiment of the invention comprises a method of forming chills in a casting to thereby reduce the tendency of iron, particularly malleable iron, to crack and tear from internal stresses during solidification. This embodiment involves inserting a chill form insert into the mold in the area where cracking is likely to occur. The insert promotes rapid freezing of the iron in the area of the insert. As a result, the iron in this area forms a skin or surface layer which has increased tensile strength, sufficient to resist the build-up of stresses during the complete solidification of the casting.

The method further contemplates that the tubular metal conduit surface which interfaces with the cast iron may or may not be coated. In a preferred embodiment, the conduit is coated with copper metal to enhance the metallurgical bond between the cast iron and steel.

As an article of manufacture, the cast product includes the metal conduit metallurgically bonded to a selected cast iron from the group consisting of white iron, compacted graphite iron, malleable iron, gray iron and ductile iron in the shape of a useful article, such as a crankshaft.

Thus, it is an object of the invention to provide an improved ferrous cast product and the method of manufacture thereof.

A further object of the invention is to provide an improved cast product and method of manufacture wherein a steel tube form is utilized as part of the mold for the casting.

Yet a further object of the invention is to provide a cast iron product and method of manufacture thereof wherein a tubular steel form is incorporated into the article to define a multi-sectioned, non-linear fluid flow passage through the article without drilling and other metal working operations.

Yet another object of the invention is to provide a method for adjusting either the weight or the center of mass of a cast product independently of adjusting the exterior design or dimensions of the cast product.

Yet still another object of the invention is to provide a method of producing a multi-component object wherein some of the components are ferrous cast components and some of the components are non-cast components, yet all of the components are metallurgically bonded so as to form a single integral object.

Still one further object of the invention is to provide a method of reducing shrinking and stress in malleable iron castings due to internal stress build-up during solidification.

Yet another object of the invention is to provide an inexpensive and highly efficient method for manufacturing cast articles having steel tubular passages therethrough.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 4 is metallographic enlargement of the metallurgical bonding between cast ductile iron and a steel insert made in accord with the method of the invention.

DESCRIPTION OF THE PREFERRED EMBODIMENT

Figure 1A:
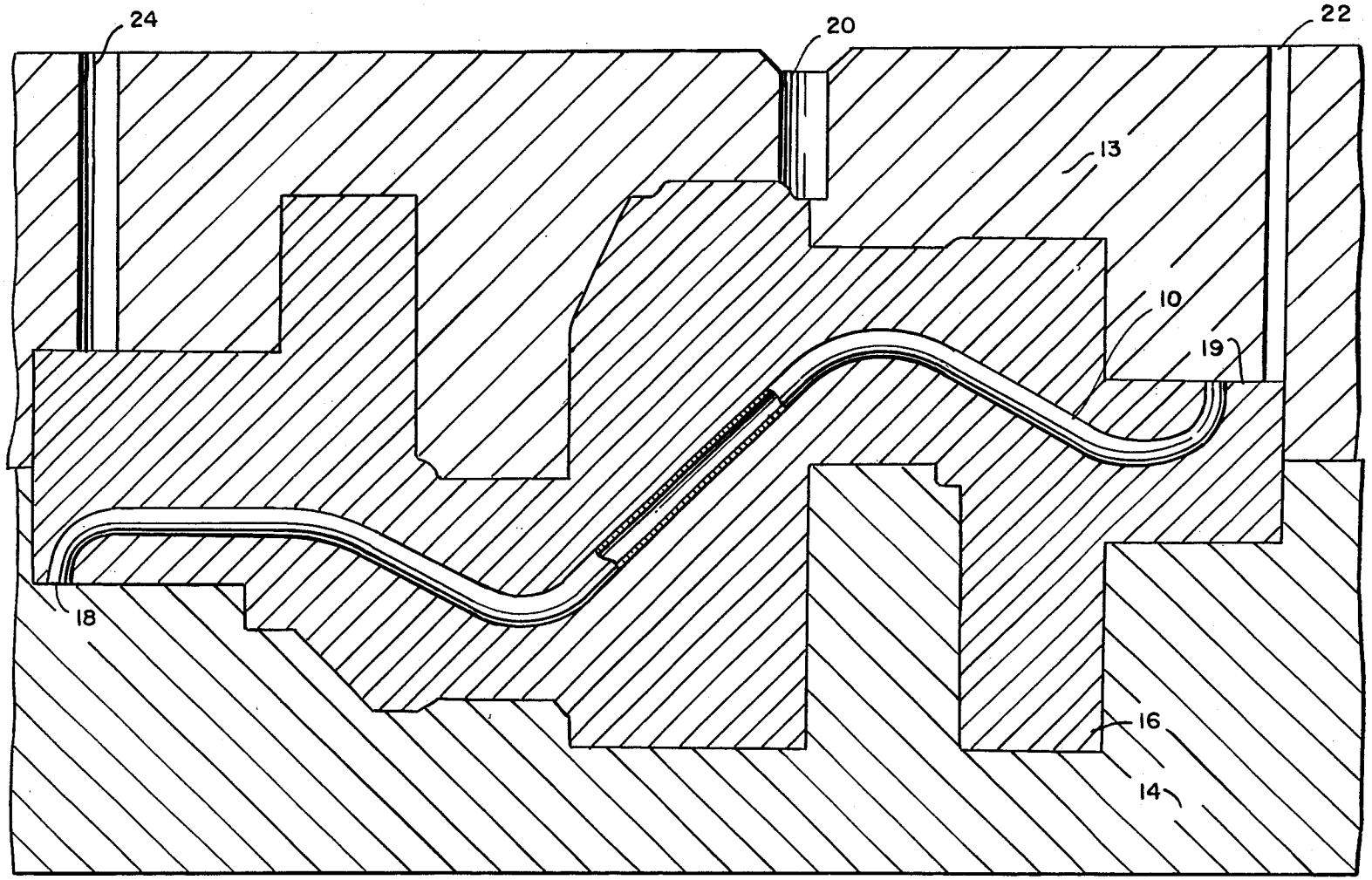
FIGS. 1A and 1B are a schematic representation of the steps in the method of the invention.

Referring to FIG. 1A which represents a particular example and embodiment of the practice of the present invention, any desired configuration and cross sectional shape of a tubular steel conduit 10 is incorporated into a mold 12 for a cast iron article. The steel tube 10 thus may define a passage through a casting by connecting through at least two points on the surface of the casting defined by the mold. In preferred form, the tube 10 defines a multi-sectioned and non-linear passage. Arcuate passages are also contemplated. Also, the tube 10 may have a constant or non-constant diameter or cross sectional shape.

The mold is comprised typically of a cope 13 and drag 14. As in FIG. 1A, the cope 13 and drag 14 define a form for a crankshaft. The tube 10, for example, defines a continuous channel through the interior of the mold form for the crankshaft 16 and connects a bearing surface 18 of the crankshaft with an oil or lubricant supply surface 20 as depicted in FIG. 1A.

In practicing the method of the invention, the tube 10 is first restrained in the mold. Cast iron is then introduced through a sprue 20 until the mold is filled as detected at gates 22, 24. The molded article (crankshaft 16 in FIG. 1B) may then be removed from the mold and machined or finished in normal fashion. A drilling operation to define a lubricant passage is not necessary because of the presence of tube 10. Tube 10 eliminates the need for drilling, plugging, and finishing operations normally required to define a flow passage in the crankshaft 16 after casting, regardless of the shape of the passage.

In the practice of the invention it is preferred to utilize low carbon steels for the tube 10. For example, 1018 to 1026 carbon steels have been found to be particularly useful. Stainless steel is not preferred. However, any commercially available steel alloy that will form a metallurgical bond with the ferrous casting and having strength properties comparable to those of either the casting or the tube is useful in the practice of the invention.

In a preferred embodiment of the invention, the surface of steel tubing which interfaces with the cast iron is coated or plated before the casting operation. Preferably the coating material is copper metal having a thickness in the range of 0.0002 to 0.0005 inches. However, various copper or tin based alloys may be utilized as a coating. The copper is electroplated on the tubing surface which will interface with the cast iron. Techniques other than electroplating may be utilized to apply the coating. For example, techniques such as metal spraying, plasma coating and others known to those skilled in the art may be used.

The cast material is a ferrous material selected from the group consisting of ductile iron, malleable iron, gray iron, and compacted graphite iron excluding white iron. It is possible, but not preferred, to utilize white iron in the practice of the invention. White iron is extremely hard and brittle and for that reason is not considered to be especially useful in the practice of the invention.

As a further embodiment of the invention, a steel tube or form may be utilized to define at least a part of an outside surface of the metal casting at a predetermined location. In that event the tube or form again may be copper plated to enhance the metallurgical bond between the cast material and the tubing. The materials and process utilized for this embodiment are essentially the same as those utilized for this embodiment are is practiced to define a passage through the casting, except that a tube is positioned in the mold so as to define a part of the external surface of the casting at the predetermined location. After the casting has solidified, the tube may be metallurgically bonded to another component at the predetermined location.

The purpose and utility of this second embodiment, as previously noted, is to provide an external steel surface which may be easily welded or otherwise worked yet which simultaneously is metallurgically bonded to a cast article. In the practice of this embodiment, the steel tube or form 26 will simultaneously define a portion of the inside surface of the mold and the outside surface of the cast articles, for example as shown by a steel ring 38 in FIG. 3.

In review, in the first step to practice the invention, steel or other metal tubing 10 is properly positioned in a mold 12 as described previously. The tubing 10 may be any one of various grades of steel tubing or alloys as also previously described. Single and double wall, welded seamless, and drawn tubing may be utilized. Tube and bar weldments, stamped, drawn and spun shapes as well as sheet steel inserts of various gauges and configurations may also be used.

Preferably the metal tubing 10 or inserts are copper plated or sprayed either by electroplating or plasma spraying on the surface which is to engage and metallurgically combine with cast iron material. A thickness of 0.0002 to 0.00003 inches of copper metal is preferred. No fluxing or protective coatings are require for the copper plated, steel insert and, in fact, such coatings or fluxing are not recommended in the practice of the process. Coatings such as chromium oxide adversely affect the casting operation and also impact adversely on the heat treatment response of some cast irons. For example, since most fluxing agents contain some type of boron, which is a very powerful carbide stabilizer, it is speculated that this can cause formation of iron carbides adjacent to the insert that cannot be subsequently removed by heat treatment. Heavy carbide formations are extremely abrasive to machine tools and are generally considered non-machinable. For these reasons, flux materials are preferably avoided.

The thickness of the tube or insert as well as the mass is an important consideration in the practice of the invention. An insert or tube wall that is too heavy or defines an area without sufficient flow of iron during the casting operation will not transfer heat properly and thus will not metallurgically fuse with the cast iron. On the other hand, a tube wall that is too thin or in an excessively hot or turbulent area of the ferrous material will erode and eventually fail. Balancing these considerations can be done empirically.

After the steel tube or insert is properly positioned within a mold form, clean, essentially slag-free iron is then poured into the mold. The iron forms a metallurgical bond with the steel. It is noted that a properly sized insert or tube will become molten at its surface when brought into contact with the molten ferrous stream. Since copper plating is highly reactive with ferrous metals, formation of an alloy of the iron and steel at the interface is promoted over a rather broad fusion zone. This occurs during solidification with the various types of irons set forth and can be enhanced by subsequent heat treatment operations particularly high temperature extended life heat treatment cycles. However, the heat treatment will not cause bonding of components where no previous bond existed and cannot therefore be used to salvage an improperly fabricated part. The design and parameters of the insert, in order to cause metallurgical bonding, are therefore quite important though they are derived empirically.

The position and configuration of gating and forming risers are also more important than in conventionally poured castings. Generally castings that have a tube running through or along a center line of a part must be sufficiently gated to reduce as much as possible the turbulence inside the mold cavity and to avoid a high velocity iron stream directly on a section of the tube. With a long thin castings, such as a crankshaft, this generally means bottom filling on a vertically parted mold and multiple gates on a horizontally parted one. Such methods reduce dirt and slag defects.

With the invention, certain classes of castings can achieve higher than normal yield figures. These castings utilize very heavy tubes which displace considerable iron and form a chill in what previously was considered an isolated, heavy section of the casting. The chilling of the iron promotes directional solidification, and the elimination of the isolated heavy section considerably reduces metal feed requirements. Machinability and utilization of such a casting thus is significantly improved.

Figure 1B:
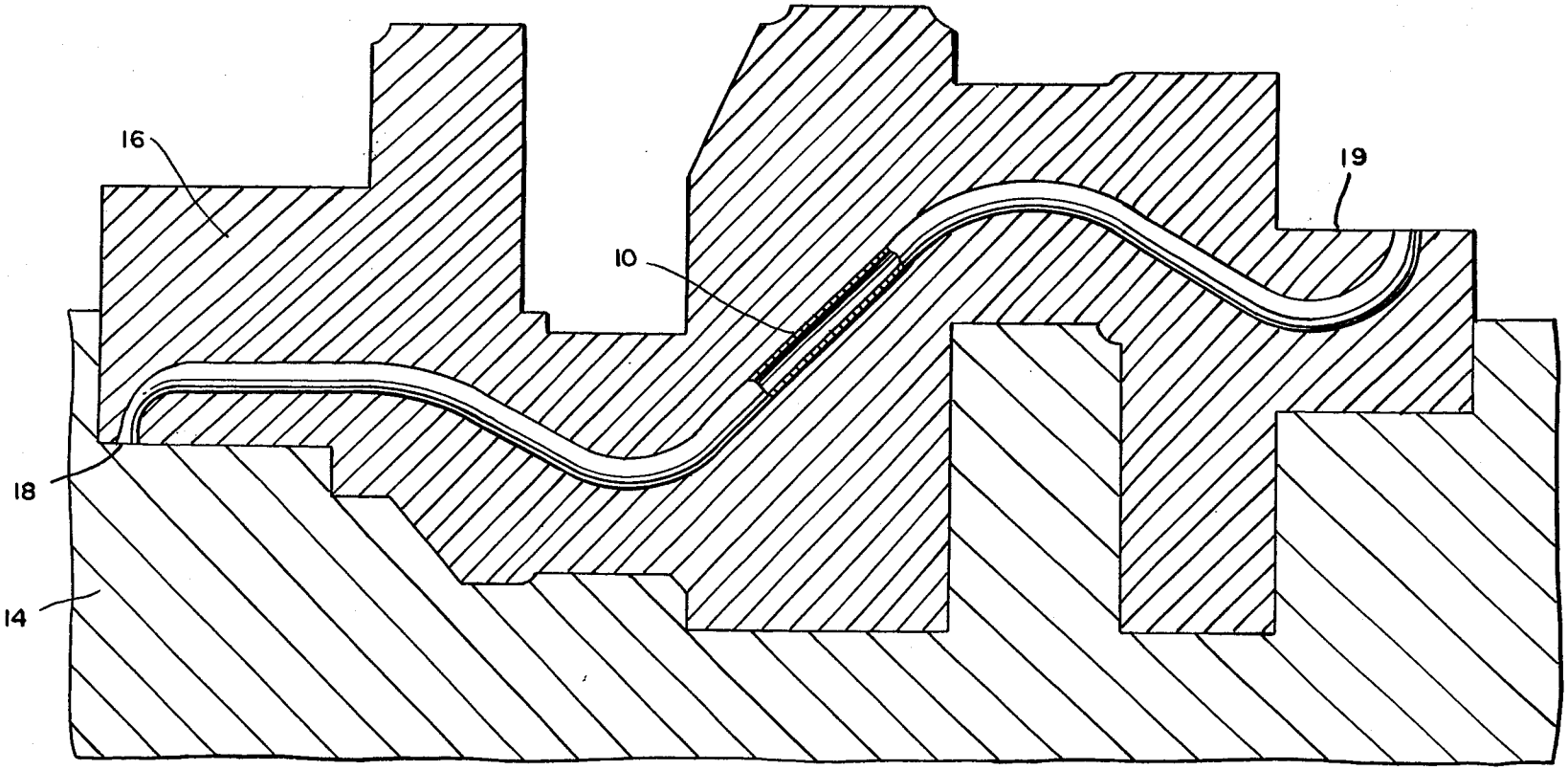
Figure 2:
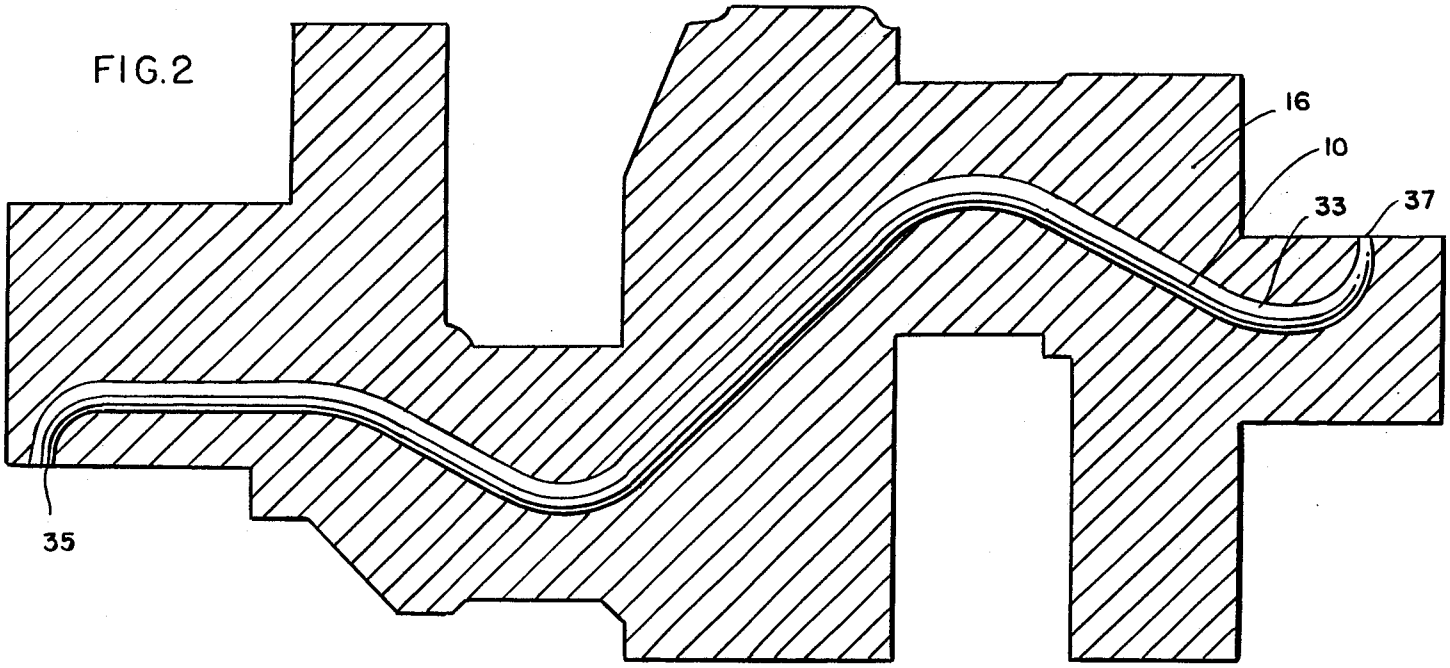
FIG. 2 is a cross sectional view of a typical crankshaft for a diesel engine air compressor with an internal tubular steel lubricant passage and made in accord with the improved casting method of the present invention.

FIG. 2 illustrates further the article made by the method of FIGS. 1A and 1B; namely, a crankshaft with a cast in place multi-sectional, non-linear oil supply passage. The method eliminates the expensive prior art series of drilling operations as well as counterboring, tapping, and plugging necessary to seal the open ends of several drilled passages that interconnect to form an extended passage. The tube 10 which is formed of steel is positioned within a mold. Cast iron flows about and solidifies over the tube 10. The tube 10 is preferably coated with copper metal. Upon removal from the mold form, the tube 10 defines a passage 33 through the casting 16. The ends 35, 37 of the tube 10 may then be easily tapped or machined.

Figure 3:
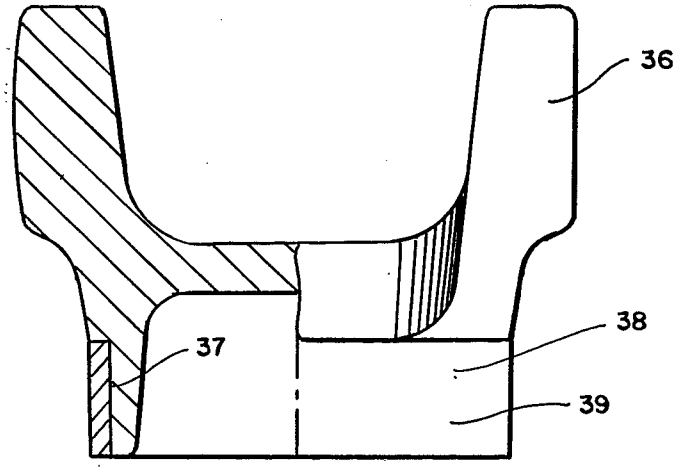
FIG. 3 is a side elevation with a partial cross sectional view of a cast iron component utilized in a typical steering gear with an outside steel surface and made in accord with the improved method of the present invention.

FIG. 3 represents a component part 36 of a power steering assembly. The mold form for the part 36 included a tubular section 38 which is a cylindrical tubular steel section which metallurgically bonds to the cast iron. The inside surface 37 of the steel tubular section portion 38 is preferably copper plated. Ductile iron is then cast over the steel section 38. The outside surface 39 of the steel tubular section 38 may be welded, machined, or otherwise worked in the manner of a normal steel tube. In preferred form, the casting 36 is metallurgically bonded to a non-cast steel component at the point of the outside surface of the steel tubing, thereby forming a multi-component device of cast and non-cast components which are metallurgically bonded together. The casting 36 is otherwise the same as prior castings except for the portion wherein the steel tubing 38 is provided.

FIG. 4 is a microphotograph depicting the metallurgical bond between steel tubing and cast iron. Ductile iron 44 is cast about a steel insert 46. Carbon has migrated into the insert from the casting forming a carbide network and causing the formation of grains that cross the fusion zone. This enhances the engagement or interlocking of the steel tube and the cast iron.

The process of the present invention may be utilized to make products such as crankshafts, drive clutch controls for air compressors, bearing caps for engines, fertilizer applicator knives requiring a passage, butterfly valve stems, the internal pump cavity for a power steering pump, and many other parts. As a particular example, in a hydraulic pump, the internal surface of the pump may be formed by a closed, steel tubular member. The tubing does not have to be cylindrical but can be any particular size and shape. The cast iron body may be metallurgically attached to the tubing by casting about the tubing.

Another example of the invention is the use of steel inserts in the casting in the form of a solid insert, i.e. form chills that reinforce an area which is prone to crack in a malleable casting. The chill effect can be used to control a tendency of malleable iron to crack and tear from internal stresses during solidification. By contrast, current practice is to form a cooling fin or crack strip in the mold or pattern that fills with iron and dissipates heat into the mold during solidification. The cooling fin remains as part of the casting and must be removed with a separate operation. However, if a steel metal insert is provided in the mold in a area where cracking is likely to occur, the insert can act as a chill and, of course, perform some minor reinforcing. However, the primary benefit is rapid chilling and freezing in the cast part thus forming a part with a skin having enough tensile strength to resist the build-up of stresses during final solidification. This eliminates the need for a crack strip and subsequent operations to remove it.

In sum, by use of steel tubing in the described cast iron articles, it is possible to reduce the weight for the article which is being cast or to alter the center of mass of the article without modifying the external design of the casting. The tubing may also be used as a wear surface or for forming a bearing surface or as a passage.

Following are tables setting forth parameters of malleable iron and ductile iron which have so far been used in combination with steel tubing, as previously described, in the manufacture of articles using the process described:

MALLEABLE IRON - CHEMISTRY RANGES

| | |
|---|---|
| Carbon | Operating range: 2.45–2.55% |

-continued

MALLEABLE IRON - CHEMISTRY RANGES

| | | | |
|---|---|---|---|
| | Mark iron under 2.35 or over 2.60% | | |
| Silicon | Operating range: 1.40–1.50% | | |
| | Mark iron under 1.35 or over 1.60% | | |
| Manganese | Operating range: 0.40–0.47% | | |
| | Mark iron over 0.50% | | |
| Chromium | Operating range: .060% Max. | | |
| | % Chromium | % Silicon | Mark iron if Si is over |
| | 0.060–0.070 | 1.45–1.55% | 1.60% |
| | over 0.070 | 1.50–1.60% | 1.60% |
| Sulfur | Operating range: 0.060–0.080% | | |
| | Sulfur may require adjustment to compensate for high manganese. | | |
| | Sulfur and manganese should stay within the relationship. % Mn = 6.25 (% S) | | |
| Aluminum | 0.0125% maximum in final iron. | | |
| | .008% minimum in final iron. | | |
| Boron | Operating range: | | |
| | 0.0014–0.0022 in furnace iron | | |
| | 0.0022–0.0030 in final iron | | |
| | Quantovac boron analysis must be adjusted for sulfur content. | | |
| Titanium | .015% maximum in final iron. | | |
| | .012% maximum in base iron | | |
| Liquidus Temperature | Operating range: 2350–2370° F. | | |

DUCTILE IRON - CHEMISTRY RANGES
Ladle Analysis: Final Iron

| | |
|---|---|
| Carbon | Normal Range: 3.55–3.75% |
| Silicon | Normal Range: 2.60–2.80% |
| | Minimum: 2.40%–Maximum: 3.00% (3.10 Wet Analysis) |
| Manganese | 0.20% Minimum–Maximum 0.45% |
| Chromium | 0.060% Maximum |
| Aluminum | 0.040% Maximum |
| Boron | 0.0018% Maximum |
| Sulfur | 0.015% Maximum |
| Phosphorus | 0.035% Maximum |
| Copper | Ferritic - 0.20% Maximum |
| | Pearlitic - 0.80% Maximum (depending on hardness) |
| Nickel | 0.05% Maximum |
| Titanium | 0.03% Maximum |
| Tin | 0.010% Maximum |
| Molybdenum | 0.015% Maximum |
| Magnesium | Normal Range: 0.045–0.055% |
| | Minimum 0.040%–Maximum 0.058% |
| Vanadium | 0.02% Maximum |
| Cerium | 0.02% Maximum |
| Lead | 0.004% Maximum |
| Zinc | 0.05% Maximum |

These cast iron compositions have been utilized for the manufacture of articles in accord with the described invention though it is possible to vary the cast iron compositions considerably. Thus, while there has been set forth a series of preferred embodiments of the invention, it is to be understood that the invention is to be limited only by the following claims and their equivalents.

What is claimed is:

1. An improved casting of the type including a passage therein, said casting comprising, in combination:

a metal conduit comprised of a tubular metal product; and cast iron selected from the group consisting of white iron, compacted graphite iron, malleable iron, gray iron and ductile iron, said cast iron having been cast to envelop at least in part the conduit, said casting including a copper coating at the interface of the conduit and cast iron, said copper coating having been fused along said interface without the use of a flux.

2. The improved casting of claim 1 wherein the thickness of the coating is about 0.0002 to 0.0005 inches.

3. The casting of claim 1 wherein the metal is a low carbon steel.

4. The casting of claim 1 wherein at least a portion of the metal conduit defines at least a portion of the exterior surface of the casting.

5. The casting of claim 1 wherein the tube is generally circular in cross section, of generally uniform diameter, and extends between two surfaces of the casting to form a throughbore in the casting.

6. The casting of claim 5 wherein the tubing comprises a first end and a second end, at least a portion of the tubing is non-linear between said first and second end, and the non-linear portion of the tubing is located within the casting between external surface of the casting, such that the throughbore in the casting is non-linear.

7. The casting of claim 6 wherein the portion of the tubing which is non-linear between the first and second ends includes a plurality of connected, non-linear sections.

8. The casting of claim 7 wherein the plurality of sections include arcuate lengths of tube as well as straight lengths of tube.

9. An improved casting of the type including a passage therein, said casting comprising, in combination:

a metal conduit comprised of a tubular metal product, wherein at least a portion of said metal conduit defines at least a portion of the exterior surface of the casting, and wherein said casting further comprises a non-cast steel metal form member metallurgically bonded to said casting and defining a portion of the exterior surface of the casting and cast iron selected from the group consisting of white iron, compacted graphite iron, malleable iron, gray iron and ductile iron, said cast iron having been cast to envelope at least in part the conduit.

10. The casting of claim 9, in combination with a steel form metallurgically bonded to the steel metal form member of the casting.

11. The combination of claim 10, wherein the two steel forms have been welded together.

* * * * *